United States Patent [19]

Verholt

[11] Patent Number: 4,598,958

[45] Date of Patent: Jul. 8, 1986

[54] PULL-OUT DRAWER FOR A FILING CASE

[75] Inventor: Johannes M. Verholt, Ulft, Netherlands

[73] Assignee: B.V. Briefhouder- en Papierwarenfabriek PAS, Netherlands

[21] Appl. No.: 634,389

[22] Filed: Jul. 25, 1984

[51] Int. Cl.[4] ..... A47B 63/00

[52] U.S. Cl. ..... 312/189; 211/54.1; 312/183; 312/193

[58] Field of Search ..... 312/193, 185, 187, 189, 312/183; 211/54.1, 50

[56] References Cited

U.S. PATENT DOCUMENTS

| | | | |
|---|---|---|---|
| 753,693 | 3/1904 | French et al. | 312/193 |
| 3,533,511 | 10/1970 | Giampa | 211/54.1 |
| 4,105,270 | 8/1978 | Bergkamp | 211/50 |
| 4,124,261 | 11/1978 | Klaus | 312/185 |
| 4,443,046 | 4/1984 | Hannah | 211/50 |

*Primary Examiner*—James T. McCall

*Attorney, Agent, or Firm*—Price, Heneveld, Huizenga & Cooper

[57] ABSTRACT

A pull-out drawer for a filing case and slidably cooperative with said case, said pull-out drawer comprising a bottom platform and a front panel being rigidly connected to said platform and carrying a handle or grip projecting from the front face of said panel. In said platform a first array of apertures is arranged next to said front panel and in parallel there with to receive paper fastener means and next to the platform edge opposite said front panel a second array.

In particular the front panel is provided laterally and at both ends with an extension being shaped as a channel across the height of the front panel and opening to the far end of the platform, the grip or handle being a rail joined along the length of the extended front panel the outer edge at both ends of the extended front panel being flush with the respective outer face of the sidewall of the case.

3 Claims, 3 Drawing Figures

PULL-OUT DRAWER FOR A FILING CASE

The present invention relates to a pull-out drawer for a filing case which slidably cooperates with said case, said pull-out drawer comprises a bottom platform and a front panel rigidly connected to said platform and having a handle or grip projecting from the front face of said panel.

In particular, similar filing cases are in use in stack type filing cabinets wherein the pull-out drawers comprise means to contain materials on top of the bottom platform. Such materials include paper sheets carrying information relating to a particular subject. The filing case then may be assigned to such a particular subject.

Recently computer processed information is presented printed out on flat-pack chained listing sheets. To enable consultation at a later date such flat packs need to be filed in a convenient way on a temporary basis.

The present invention has an object to provide filing means for paper sheets.

A further object is to provide filing means for a flat-pack of chained listing sheets.

These objects and still further objects are attained in a pull-out drawer as above in that in said platform a first array of apertures is arranged next to said front panel and in parallel therewith to receive paper fastener means. Next to the platform edge opposite from said front panel a second array is provided.

In particular, the front panel is provided laterally and at both ends with an extension shaped as a channel across the height of the front panel and opening toward the far end of the platform, the grip or handle being a rail joined along the length of the extended front panel. The outer edge at both ends of the extended front panel is flush with the respective outer face of the sidewall of the case.

The invention will be illustrated by a description of a preferred embodiment referring to drawings wherein.

Figure 1:
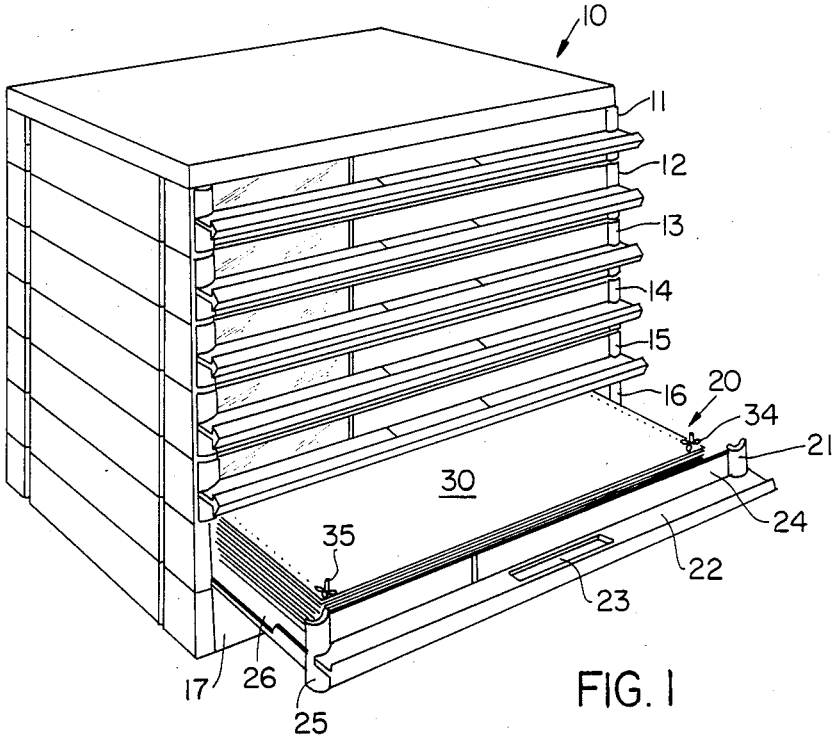
FIG. 1 shows a filing cabinet comprising a stack of filing cases each comprising a pull-out drawer according to the invention.

FIG. 1 shows a filing cabinet 10 comprising a stack of cases 11, 12, 13, 14, 15, 16 and 17. The bottom case 17 is a dummy to provide a bottom support. The cases 11–16 being identical, a description of case 16 will suffice. Case 16 comprises a drawer 20 including a front panel 24 and a bottom platform 26 rigidly joined together. A flat pack of paper sheets 30 is fastened to platform 26 by means of fasteners 34 and 35. Channels 21, 25 extend front panel 24 laterally within the outlines of case 16. Both channels extend the height of front panel 24. A grip or handle to pull out drawer 20 from its case 16 is shaped as a rail 22 extending substantially along the full width of the extended front panel 24 inclusive of extensions 21, 25. In fact, rail 22 is backing up or reinforcing channels 21, 25 which are intended for use in a vertical filing device, a trolley for example. Centrally in rail 22 a hand opening 23 is arranged for convenient handling.

Figure 2:
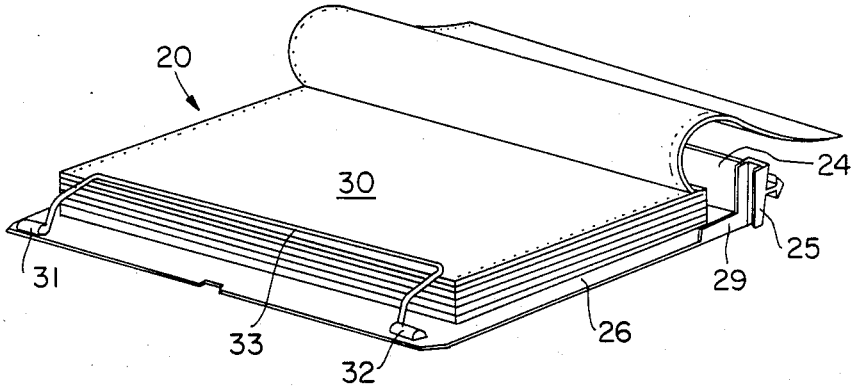
FIG. 2 shows a pull-out drawer as in FIG. 1 in a different perspective.

FIG. 2 shows drawer 20 in a different perspective. In addition to FIG. 1 it shows a bracket 29 to add to the rigid joining of front panel 24 and bottom platform 26. Also a clamping device 33 is received in apertures in the fittings 31 and 32 along the far edge of platform 26 to hold the pack of paper sheets 30 flat.

Figure 3:
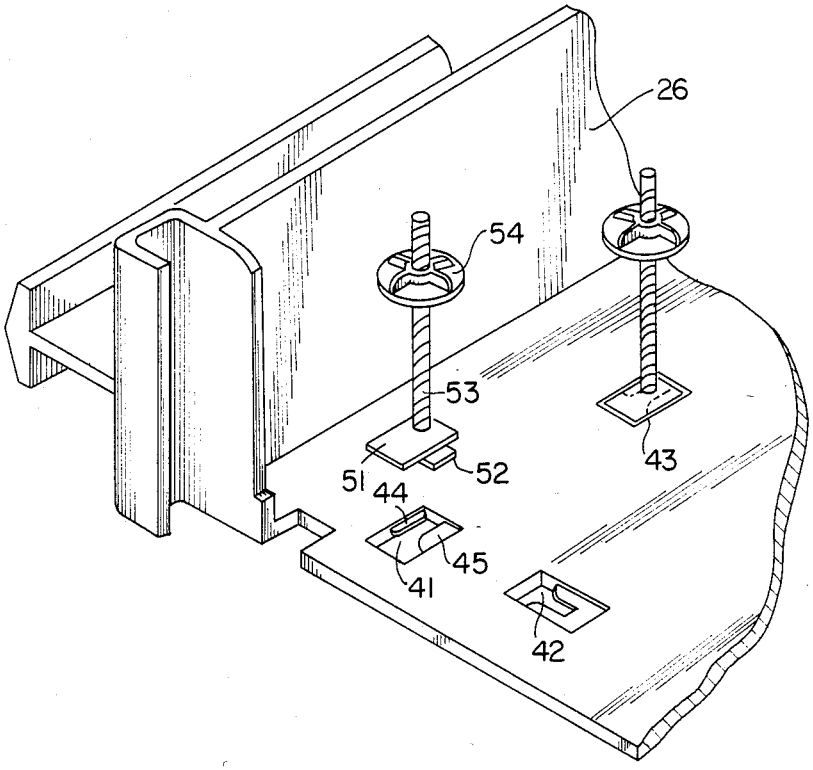
FIG. 3 shows details of a pull-out drawer according to the invention.

FIG. 3 shows details of the apertures in platform 26 and of an embodiment of a fastener. Apertures 41, 43 are slots directed in parallel with front panel 26. Inside slot 41 wing means 44, 45 extending over a fraction of its length are arranged to be received in a channel portion 52 of a rectangular foot 51 of a threaded pin or post 53 carrying a nut 54. Foot 51 being of a resilient material, the channel portion 52 can be placed next to the wing means 45 in aperture 41 and pushed into position. Foot 51 then fills aperture 41, as shown in relation to aperture 43.

A pull-out drawer according to the invention thus is adapted for multiple use, viz. actually as a pull-out drawer in a filing case; as a hanging file on rails mounted in an open trolley; and as a hanging file to be pushed in a channel comprised in a front door cabinet.

I claim:

1. A pull-out drawer for a filing case the drawer being slidably mounted in the case, said pull-out drawer comprising a bottom platform and a front panel rigidly connected thereto, said front panel having a handle projecting from its front face, said drawer characterized in that a plurality of elongated apertures are provided in said platform adjacent said front panel, said apertures being both arranged and elongated parallel to said front panel, each of said apertures having mounted therein a pair of wing means extending a portion of the length of the aperture and laterally into the aperture a portion of its width to form a slot both shorter and narrower than the aperture; threaded posts each having at its lower end a resilient foot piece of the same size as the aperture to seat in and close the top of one of the apertures; means on each post below said foot piece forming a channel element adapted to be moved lengthwise of said slot to engage said wing means to secure the post to the platform; the foot piece resiliently entering the aperture when the post is properly positioned for locking the post in place.

2. The pull-out drawer described in claim 1 wherein said front panel extends the full width of the platform and extends upwardly from the platform, a channel integral with and at both ends of the front panel, said channels extending vertically the full height of the front panel, being generally U-shaped in cross section with the open face of the channels directed rearward, a forwardly extending handle integral with the front panel throughout its entire length and positioned intermediate its top and bottom edges and beyond the ends of the front panel and laterally across and integral with the front faces of said channels for reinforcing said front panel and both of said channels.

3. The pull-out drawer described in claim 2 wherein said filing case has a pair of sides spaced to receive said platform between them, said channels being of a width equal to the thickness of said sides and seating against and covering the front edges of said sides when said drawer is closed; clamp means secured to said platform adjacent and parallel to the edge thereof opposite from said front panel and adapted to extend over the adjacent face of a pack of paper seated on the platform.

* * * * *